US006618915B2

(12) United States Patent
Giampavolo

(10) Patent No.: US 6,618,915 B2
(45) Date of Patent: Sep. 16, 2003

(54) SEATBELT WITH CHILD RESISTANT BUCKLE

(76) Inventor: Paul Giampavolo, 9 Hasta Way, Newton, NJ (US) 07860

( * ) Notice: Subject to any disclaimer, the term of this patent is extended or adjusted under 35 U.S.C. 154(b) by 0 days.

(21) Appl. No.: 10/081,353

(22) Filed: Feb. 21, 2002

(65) Prior Publication Data

US 2002/0112326 A1 Aug. 22, 2002

Related U.S. Application Data

(63) Continuation-in-part of application No. 09/952,070, filed on Sep. 13, 2001.

(60) Provisional application No. 60/270,996, filed on Feb. 22, 2001.

(51) Int. Cl.[7] ..... A44B 11/25; A44B 11/26

(52) U.S. Cl. ..... 24/614; 24/625; 280/33.993

(58) Field of Search ..... 24/302, 614, 615, 24/616, 625, 633, 664, 647; D11/216, 218; 280/33.993, 33.992, 33.991; 224/159, 160, 275; 297/250

(56) References Cited

U.S. PATENT DOCUMENTS 5,263,726 A * 11/1993 Wood ..... 280/33.992
5,465,472 A * 11/1995 Matoba ..... 24/625
5,546,642 A * 8/1996 Anscher ..... 24/625
5,791,026 A * 8/1998 Anscher ..... 24/615
6,101,687 A * 8/2000 Giampavolo et al. ..... 24/302
6,148,486 A * 11/2000 Uehara et al. ..... 24/615 X
6,263,549 B1 * 7/2001 Uehara ..... 24/625
6,446,314 B1 * 9/2002 Anscher ..... 24/614

FOREIGN PATENT DOCUMENTS

WO 0221956 3/2002

OTHER PUBLICATIONS

US 2002/0017011 A1, [Kavamura] filed Jun. 28, 2001, published Feb. 14, 2002.*

* cited by examiner

*Primary Examiner*—Robert J. Sandy
(74) *Attorney, Agent, or Firm*—Ostrolenk, Faber, Gerb & Soffen, LLP

(57) ABSTRACT

A seatbelt assembly with a buckle has male and female mating parts, in which the male part includes features to prevent disengagement operation by a child. The child resistant features include added ribs, webbing in the form of flanges or struts, or barbs or prongs that increase the difficulty for disengaging the buckle. The female part can have an arcuate outer surface to increase the overall durability of the buckle and resist damaging external forces or damaging misuse. The female part can also be provided with lateral shoulders to make the female part harder to withdraw and thus more child resistant. The seatbelt assembly with the child resistant buckle can be operated easily by an adult, while remaining secure from disengagement by a typical child.

21 Claims, 9 Drawing Sheets

MALE

FEMALE

MALE

FEMALE

SEATBELT WITH CHILD RESISTANT BUCKLE

RELATED APPLICATIONS

This application is a Continuation-In-Part of application Ser. No. 09/952,070, filed Sep. 13, 2001, entitled CHILD RESISTANT BUCKLE, and is based upon and claims benefit of application Ser. No. 60/270,996, filed Feb. 22, 2001, entitled CHILD RESISTANT BUCKLE, to which a claim of priority is hereby made.

BACKGROUND OF THE INVENTION

The present invention is directed to a child seatbelt assembly with a child resistant buckle and, in particular, to an improvement in the type of buckle commonly used in many children's safety seats, strollers, baby carriages, shopping cart seat belts, etc. A prior art buckle for use with a seatbelt assembly is made, for example, by Illinois Tool Works (ITW) and others and is well known. Referring to FIG. 7, a prior art buckle has two latch members 10 of a male part 20 that slide into a slot 12 of a female part 30 and have barbed ends 14 that engage in female part 30. The prior art buckle can be manipulated, by some young children, in a way that permits the buckle to be undone. As is well known, the two barbed ends 14 are pressed toward each other to allow male part 20 of the buckle to be removed from female part 30.

Others have attempted to provide a child resistant buckle for use with a seatbelt assembly. For example, see Gallbreath, U.S. Pat. No. 5,991,985 which provides a third fastening element and includes a depressable button to allow the third fastening element to be undone. This buckle is cumbersome because it requires that the user learn an additional motion in order to undo it, i.e., the user must at the same time depress the side latches and the center button to undo the buckle and release the seatbelt strap.

Retainer strap seatbelt assemblies with conventional buckles are disclosed in U.S. Pat. Nos. 6,101,687 and 6,101,690, which are incorporated herein by reference in their entireties. These seatbelt assemblies are typically used in shopping carts to help restrain children in the carts and prevent injury. Accordingly, child resistant buckles are an important feature of these seatbelt assemblies.

When the types of buckles and straps described above are used in an environment where the buckles are typically subjected to high impact and compression forces, the buckle can be damaged. A typical application for the buckles and straps are on child safety restraints, or seatbelts, used on grocery shopping carts. When carts are nested together with one another for storing large numbers of carts easily, for example, the buckles can be caught between the carts and be subjected to high impact and compressive forces. Impact forces like these tend to cause the buckle to crack or even shatter. Compressive forces can deform the buckle beyond a point of elastic resilience, resulting in an unworkable buckle.

In addition, the seatbelt assembly is sometimes misused in connecting grocery carts together. These occasions of misuse can produce high tensile strain on the buckle, causing the buckle to fail and resulting in damage to buckle components.

SUMMARY OF THE INVENTION

It is an object of the present invention to overcome the drawbacks associated with the prior art.

It is a further object of the present invention to provide a simple seatbelt assembly with a child resistant buckle while maintaining design and operating features similar to those provided in the prior art.

It is a further object of the present invention to provide a seatbelt assembly that is resistant to high tensile, impact and compressive forces.

Briefly stated, according to the present invention there is provided a seatbelt assembly with a buckle with male and female mating parts, in which the male and female parts include features to prevent disengagement operation by a child. The child resistant features include added ribs, webbing in the form of flanges or struts, or barbs or prongs that increase the difficulty for disengaging the buckle. The buckle can be operated easily by an adult, while remaining secure from disengagement by a typical child. The female part has an arcuate outer profile to improve the structural integrity of the overall buckle. Both the male and female parts can have thickened portions to permit the seatbelt assembly to be child resistant, while improving resistance to tensile, impact and compressive forces.

DETAILED DESCRIPTION OF THE PREFERRED EMBODIMENTS

Figure 1:
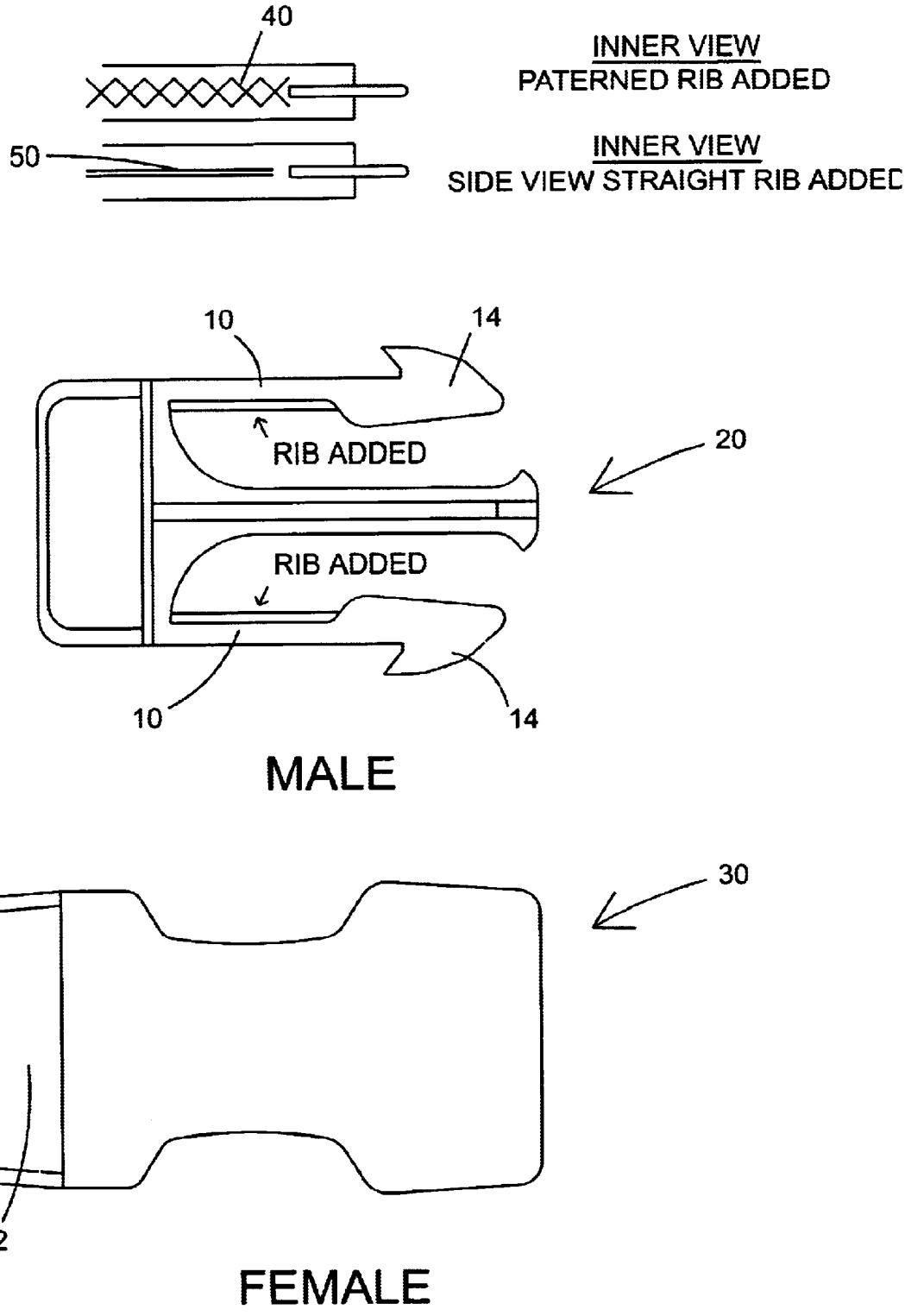
FIG. 1 is a plan view of a male and female mating connectors according to a first embodiment of the present invention.
Figure 2:
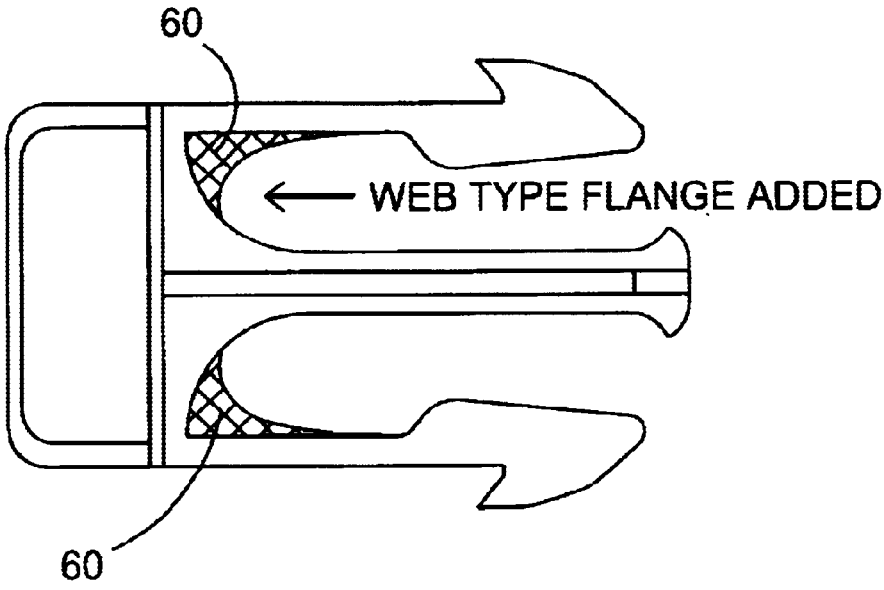
FIG. 2 is a plan view of the male and female connectors of a second embodiment according to the present invention.
Figure 2:
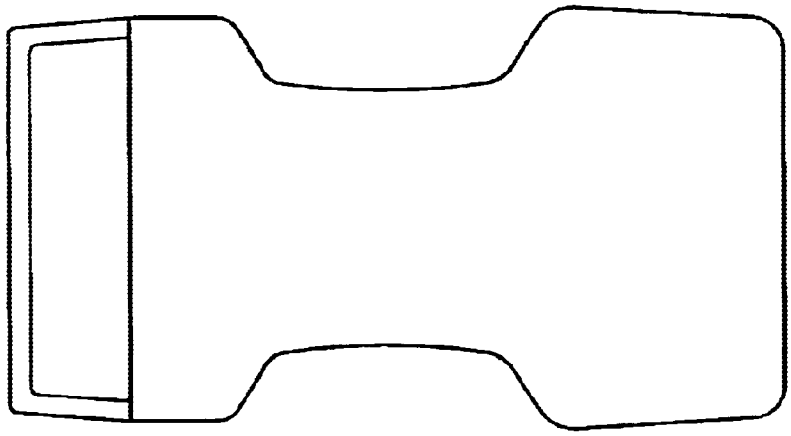
Figure 3:
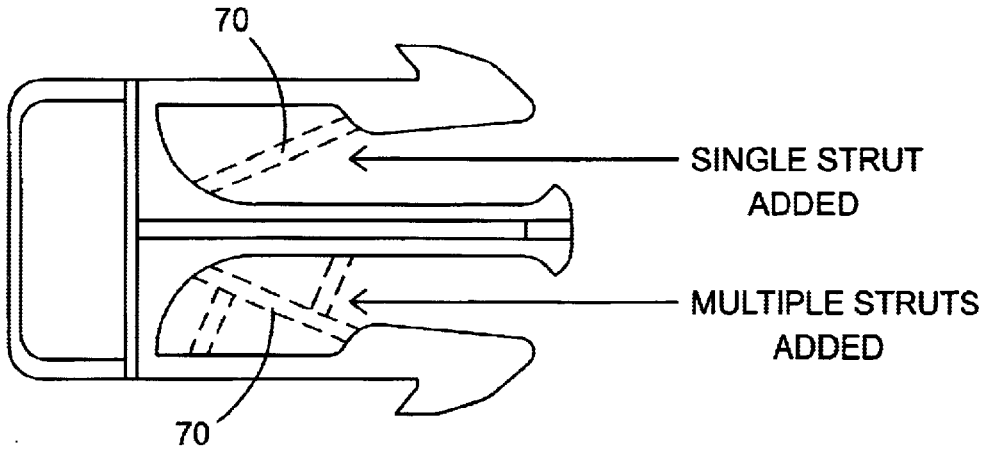
FIG. 3 is a plan view of a male and female buckle part according to a third embodiment of the present invention.
Figure 3:
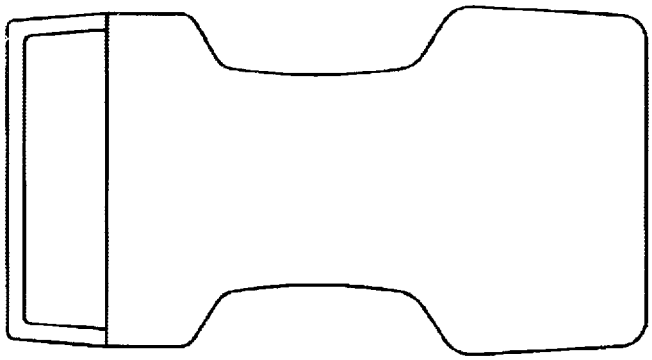
Figure 4:
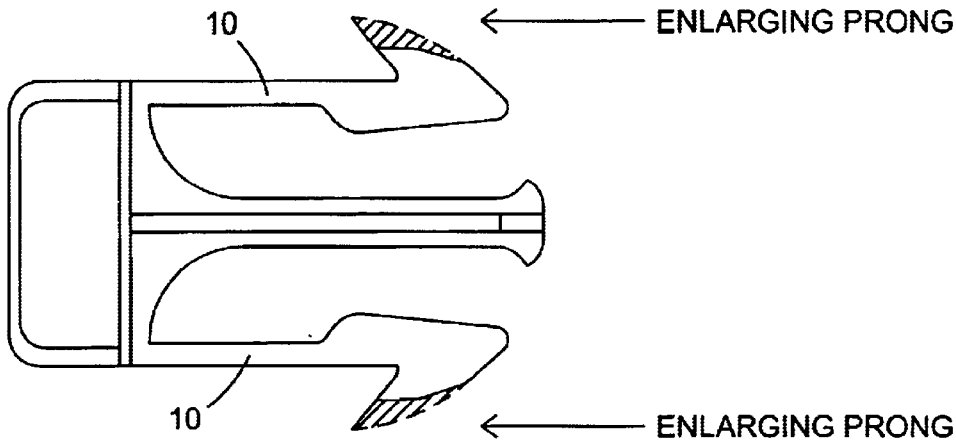
FIG. 4 is a plan view of a male and female buckle part according to a fourth embodiment of the present invention.
Figure 4:
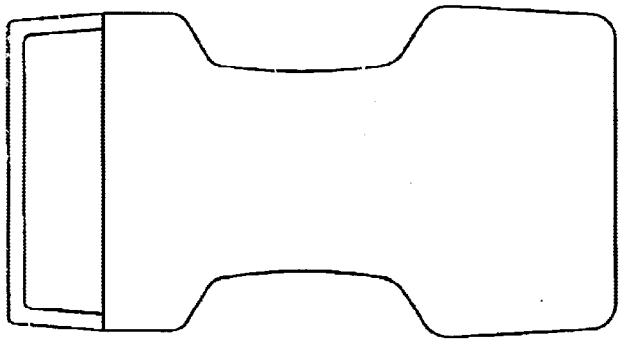

The present invention provides a simpler child resistant buckle with design and operating features that are substantially the same as the prior art buckle made by ITW and others for use with seatbelt assemblies. The buckle is resistant to tensile, impact and compressive forces, and is operated conventionally to undo the buckle and is thus more easily used by consumers. In contrast to the prior art ITW buckle, however, the amount of force required to undo the buckle is increased, thereby preventing young children from undoing the buckle. Referring to FIGS. 1–4, in which like elements are designated with like reference designations, in order to make the prior art buckle child resistant, according to one embodiment, the side latches 10 are reinforced with a strengthening structure to increase the force necessary to undo the buckle. For example, as shown in the drawings, a patterned rib 40 or straight rib 50 may be added, webbing 60 can be added in the form of a flange or struts 70, either single or multiple struts, which are collapsible upon the application of a threshold force can be provided. According to another embodiment, as shown in the attached drawings (FIG. 4), the barbs or prongs are enlarged so that it is required that the side latches 10 be depressed further to enable them to be undone.

Figure 5:
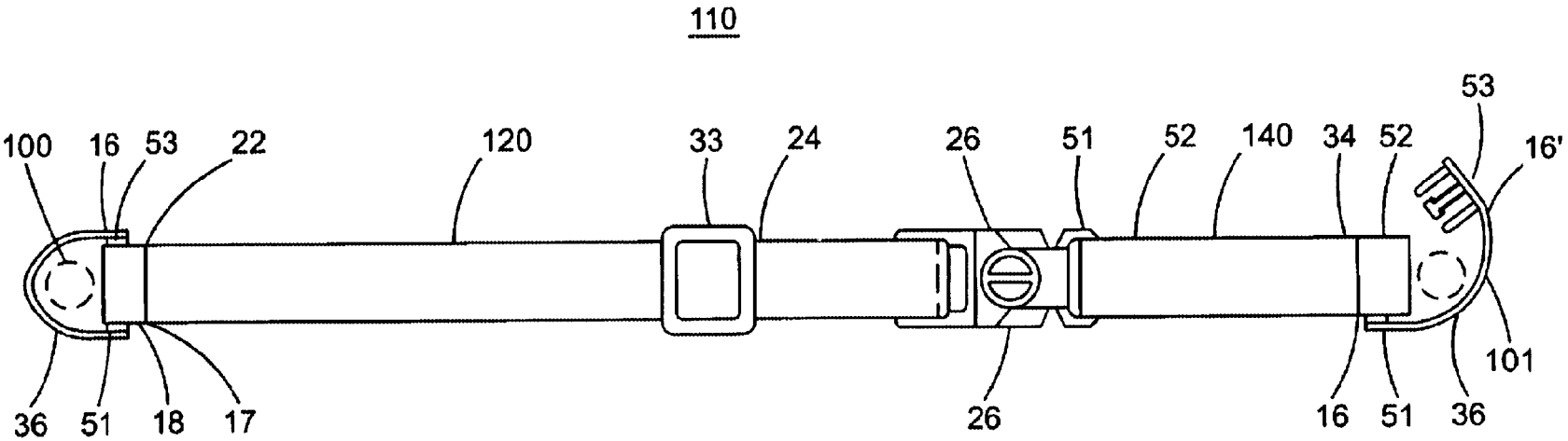
FIG. 5 is a plan view of a child seatbelt assembly according to the present invention.

Referring now to FIG. 5, a child restraint seatbelt assembly 110 is shown. Seatbelt assembly 110 includes a first strap portion 120 and a second strap portion 140. First and second strap portions 120 and 140 can be coupled to a device for carrying or restraining a child, such as a shopping cart for example. Bars 100 and 101 are illustrated in phantom in FIG. 5 to show parts of a typical shopping cart to which assembly 110 can be attached.

Strap retainers 16 and 16' permit strap portions 120, 140 to be fastened to a shopping cart without the use of tools. Any type of retainer mechanism including clasps, rings and loops can be used. The retainer mechanism should not be considered to be so limited, however, and need only function to attach strap portions 120, 140 to an object. Assembly 110 can be adjusted with a known belt adjuster 33. FIG. 5 shows female and male buckle connector parts 26 and 28, respectively. Buckle connector parts 26 and 28 are fastened to strap portions 140, 120, respectively in a known manner.

Figure 6:
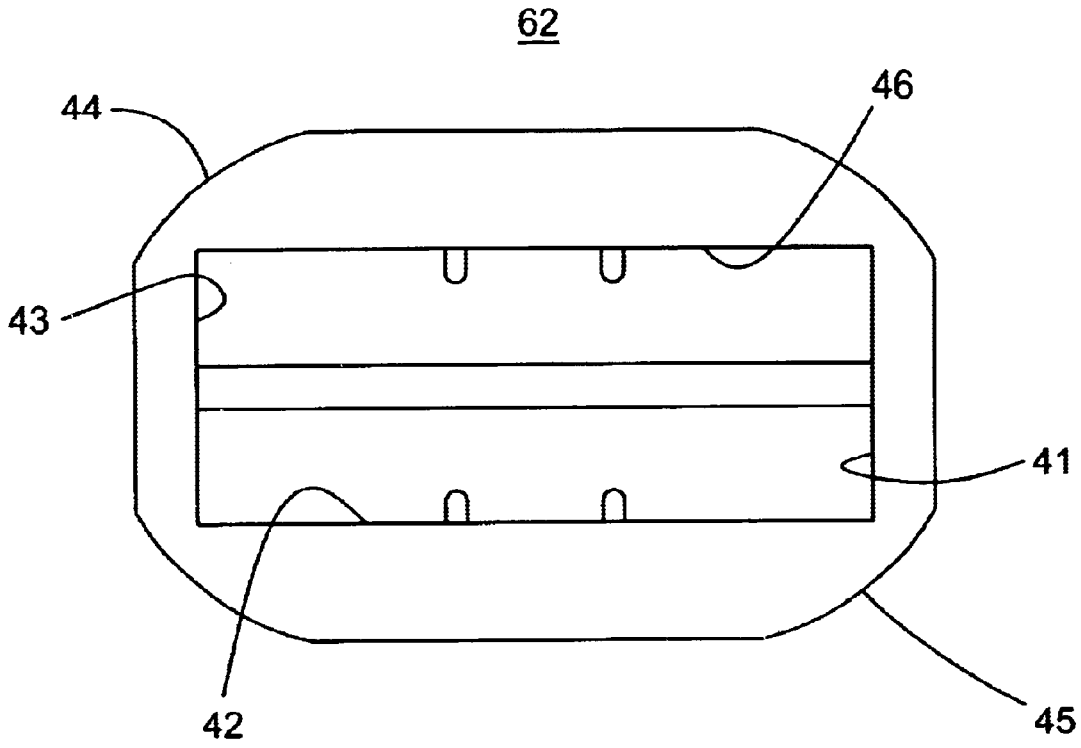
FIG. 6 is an end side view of an embodiment of a female connector according to the present invention.

Referring now to FIG. 6, a female buckle connector part 62 according to the present invention is shown. Connector part 62 has a partially oval shape described by arcuate section surfaces 44 and 45, with a rectangular inner surface shape defined by planar surfaces 41, 42, 43 and 46. Accordingly, a standard male connector, or male connector part 20 according to the present invention can fit into and engage with female connector part 62. Arcuate surfaces 44 and 45 provide a structural integrity enhancement to female connector part 62 because a cross-section of material between surfaces 44 and 46, for example, is dome-shaped. In addition, the increased material between surfaces 44 and 46, for example, as compared to prior art connectors, enhances the ability of connector part 62 to withstand external forces, including increased tensile, impact and compression forces. For example, it is estimated that the advantages of the design of connector part 62 described above results in a threefold increase in resistance to impact forces. The design of connector part 62 also resists deformation that can occur with applied compressive forces. Because of the greater resistance to external forces exhibited by connector part 62, a more substantial male connector part can be used. Use of more substantial male connector can increase overall resistance of the buckle to external tensile, impact and compression forces. A more substantial male connector can also further assist the child-safety feature of the present invention and provide a more robust and longer lasting seatbelt assembly.

Figure 7:
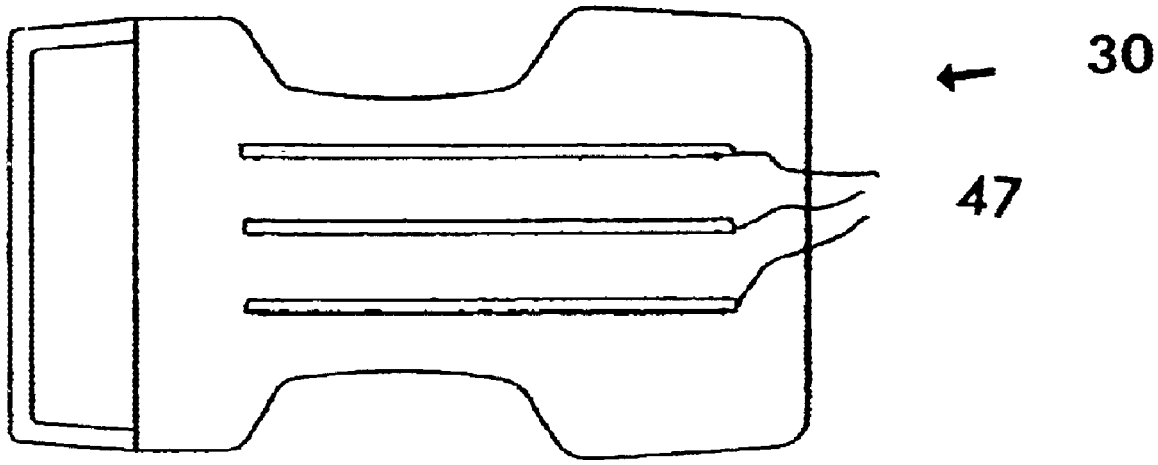
FIG. 7 is a plan view of another embodiment of a female connector according to the present invention.

It should be clear that the embodiment shown in FIG. 6 is not limiting for the present invention, in that a number of strengthening structures can be used. For example, FIG. 7 illustrates arcuate section surface 44 with several ribs 47 extending in a lengthwise direction. It should be apparent that ribs 47 can extend in any direction. A series of arcuate surfaces covering separate portions of connector part 62 can be used as will. A reinforcing structure can also take the form of a web, or criss-crossed ribs. Additionally, each of these reinforcing or strengthening structures can be used in combination with each other, or with other similar structures for reinforcement or strengthening.

Figure 8:
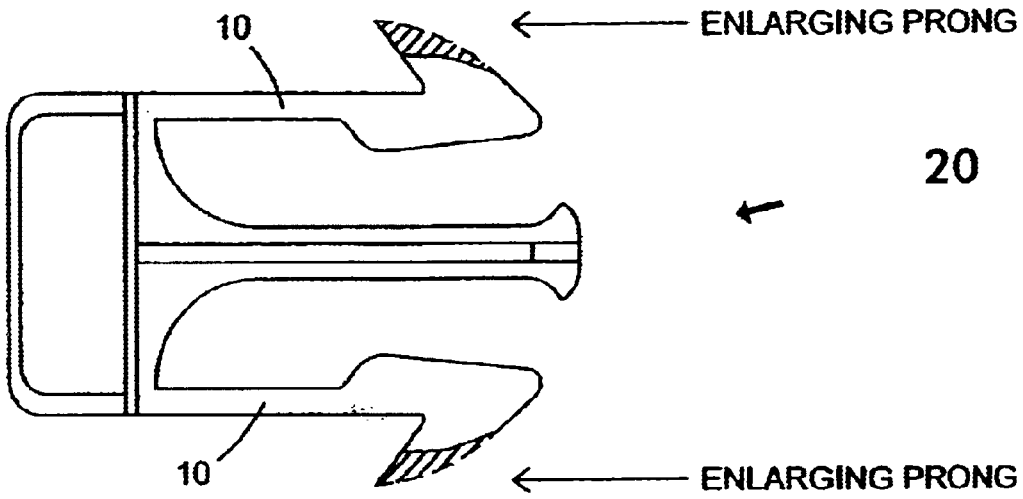
FIG. 8 is a cutaway plan view of another embodiment of a female connector according to the present invention.
Figure 8:
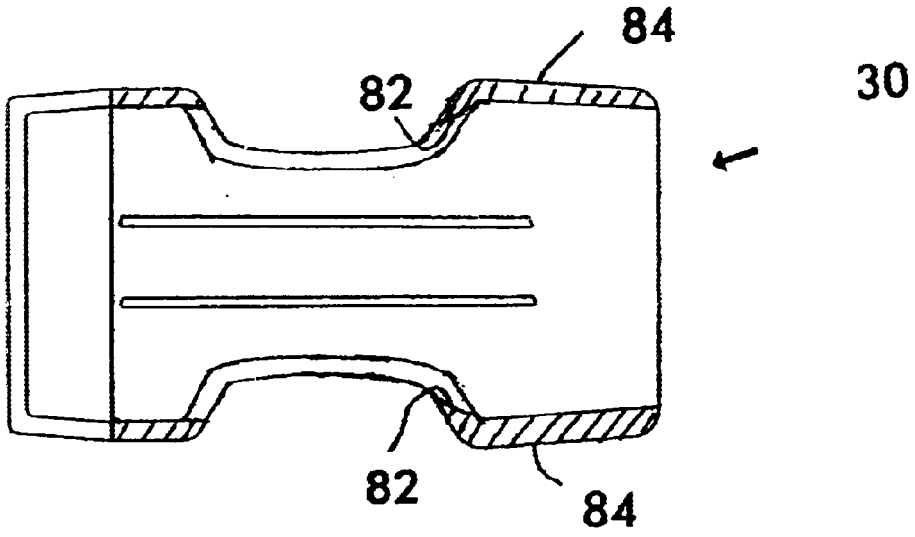
Figure 9A:
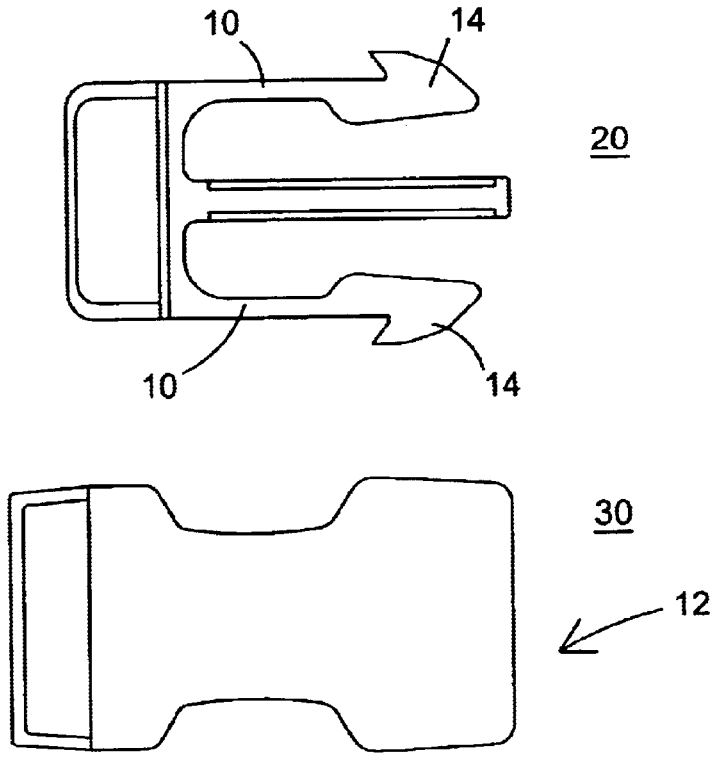
PRIOR ART FIG. 9a
FIG. 9*a* is a plan view of a conventional male and female mating connector.
Figure 9B:
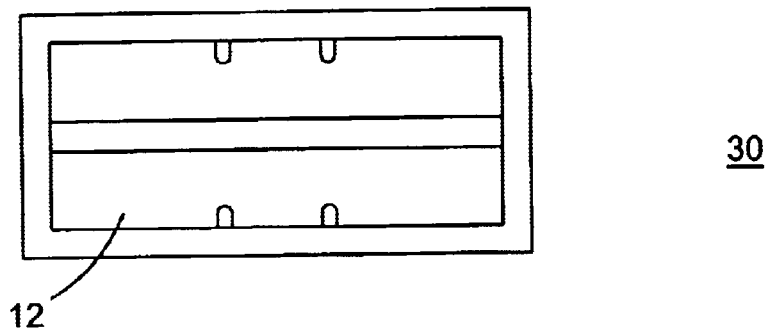
PRIOR ART FIG. 9b
FIG. 9*b* is an end view of a conventional female mating connector.

While FIGS. 1–4 show child safety improvements to male connector 20, female connector 30 can also include resistant features. Referring to FIG. 8, for example, a shoulder portion 82 of lateral sides 84 of female connector 30 provides an extended engagement surface. By providing extensions to the shoulder portion 82, the prongs on male connector 20 do not disengage from female connector 30 until side latches 10 are compressed together a further distance.

The invention thus provides a simpler, more intuitive way of providing a child resistant buckle for a seatbelt assembly that utilizes the same releasing actions as in the prior art buckle so that consumers will be accustomed to its use the first time it is used. The buckle only requires that a greater force be applied to undo it and release the seatbelt assembly. The force required should be enough so that the buckle is incapable of being undone by a typical child but can be operated by the children's parents or guardians or other adult supervisors.

The female connector of the present invention can absorb greater external forces and results in a more robust design overall. With a stronger female connector according to the present invention, a stronger male connector can also be used, effectively improving child-resistancy of the seatbelt assembly without adding further complexity. The arcuate shape of the female connector part surfaces achieves greater strength while avoiding a large increase in the amount of material needed.

Although ribs, struts, webs, flanges and enlarged barbs are shown for the male connector, other embodiments can be developed which are in accordance with the concepts disclosed herein. Although arcuate surfaces are shown for the female connector, other embodiments including those described hereinabove, can be developed and applied that are in accordance with the concepts disclosed herein. Further, combinations of the above embodiments can be provided. Further, the enlarged prongs or barbs of FIG. 4 can be provided along with strengthened latch parts as in FIGS. 1 to 3. Further, the invention is preferably used with a polymer known as ST801, in formulations greater than 50%, although it can be used with other polymers or other formulations. In addition, one or more surfaces of the female connector can have arcuate surfaces to increase the strength of the connector.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A child seatbelt assembly having a buckle, comprising:

a first and second strap portion each having a retainer member on one end for respectively retaining said first and second strap portions to an object, said first and second strap portions each having a connector receiving member on another end;

a female connector of said buckle having lateral supports near a first end secured to a connector receiving member of said first or second strap portion;

a male connector of said buckle having secured to another connector receiving member of said first or second strap portion and having laterally resilient flexible tangs each having an inner region opposing each other;

said lateral supports can receive said tangs when said male connector is inserted into said female connector;

said tangs being urged towards each other upon being received by said lateral supports;

at least one of said tangs having a length sufficient to extend beyond said lateral supports when said male connector is inserted a distance into said female connector, whereby said at least one tang is no longer urged towards another tang and abuts an inner end of a respective one of said lateral supports to resist withdrawal of said male connector from said female connector; and a structural member connected to said at least one tang sufficient to increase an urging force needed to disengage said at least one tang from said inner end to permit withdrawal of said male connector from said female connector.

2. The seatbelt assembly according to claim 1, wherein said structural member is a rib aligned along a length of said at least one tang.

3. The seatbelt assembly according to claim 1, wherein said structural member is a flange attached between said at least one tang and a body member of said male connector.

4. The seatbelt assembly according to claim 1, wherein said structural member includes at least one strut connected between said at least one tang and a body member of said male connector.

5. A child seatbelt assembly having buckle, comprising:

a strap portion having a retainer member on one end for retaining said strap portion to an object and a connector receiving member on another end;

a female connector of said buckle having lateral supports with inner ends;

a male connector of said buckle having laterally resilient flexible tangs;

at least one of said male and female connectors being coupled to said connector receiving member;

said lateral supports arranged to urge said tangs toward each other when said male connector is inserted into said female connector;

at least one of said tangs having a length sufficient to extend beyond a respective lateral support when said male connector is sufficiently inserted into said female connector, whereby said at least one tang is no longer urged towards another tang and engages a respective inner end to resist withdrawal of said male connector from said female connector; and an enlarged prong on an end of said at least one tang, whereby said at least one tang is displaced a greater distance to permit disengagement of said male at least one tang from said inner end.

6. A buckle comprising:

a female connector with lateral supports near a first end;

a male connector with laterally resilient flexible tangs;

said lateral supports can receive said tangs when said male connector is inserted into said female connector;

said tangs being urged towards each other upon being received by said lateral supports;

said tangs having a length sufficient to extend beyond said lateral supports when said male connector is inserted a distance into said female connector, whereby said tangs are no longer urged towards each other and abut an inner end of said lateral supports to resist withdrawal of said male connector from said female connector; and said female connector having an arcuate outer surface to form a thickened wall section to thereby increase a resistance of said buckle to externally applied forces.

7. The buckle according to claim 6 in combination with a child seatbelt assembly, the assembly comprising:

a first and second strap portion each having a retainer member on one end for respectively retaining said first and second strap portions to an object;

said first and second strap portions each respectively having a connector receiving member on another end; and said male connector secured to a connector receiving member of said first or second strap portion and said female connector secured to another connector receiving member of said first or second strap portion.

8. The buckle according to claim 6, wherein said male connector further comprises a structural member connected to said tangs sufficient to increase an urging force needed to move said tangs toward each other to permit withdrawal of said male connector from said female connector.

9. The combination according to claim 7, wherein said male connector further comprises a structural member connected to said tangs sufficient to increase an urging force needed to move said tangs toward each other to permit withdrawal of said male connector from said female connector.

10. The buckle according to claim 6 wherein said arcuate outer surface forms a dome shape with an opposed inner surface of said female connector.

11. The buckle according to claim 10, wherein a dome-shaped portion of said female connector is defined by solid material.

12. The buckle according to claim 11, wherein at least one of said male and said female connector is more than 50% composed of a polymer material exhibiting durability and flexibility.

13. A child seatbelt assembly having a buckle, comprising:

a first and second strap portion each having a retainer member on one end for respectively retaining said first and second strap portions to an object, said first and second strap portions each having a connector receiving member on another end;

a female connector of said buckle having lateral supports near a first end secured to said connector receiving member of said first or second strap portion;

a male connector of said buckle having lateral resiliently flexible tangs secured to said other connector receiving member of said first or second strap portion;

said lateral supports can receive said tangs when said male connector is inserted into said female connector;

said tangs being urged towards each other upon being received by said lateral supports;

said tangs having a length sufficient to extend beyond said lateral supports when said male connector is inserted a distance into said female connector, whereby said tangs are no longer urged towards each other and abut an inner end of said lateral supports to resist withdrawal of said male connector from said female connector; and a structural member on an outer surface of said female connector sufficient to increase a thickness of a wall of said female connector to thereby improve resistance of said female connector to externally applied forces.

14. The seatbelt assembly according to claim 13, wherein said structural member is an arcuate outer surface, whereby a cross-section of said female connector has a dome-shaped section.

15. The seatbelt assembly according to claim 13, wherein said structural member is a rib.

16. A child seatbelt assembly having a buckle, comprising:

a first and second strap portion each having a retainer member on one end for respectively retaining said first and second strap portions to an object, said first and second strap portions each having a connector receiving member on another end;

a female connector of said buckle having lateral supports near a first end secured to a connector receiving member of said first or second strap portion;

a male connector of said buckle having lateral resiliently flexible tangs secured to another connector receiving member of said first or second strap portion;

said lateral supports can receive said tangs when said male connector is inserted into said female connector;

said tangs being urged towards each other upon being received by said lateral supports;

said tangs having a length sufficient to extend beyond said lateral supports when said male connector is inserted a distance into said female connector, whereby said tangs are no longer urged towards each other and abut an inner end of said lateral supports to resist withdrawal of said male connector from said female connector; and a structural member on said female connector sufficient to increase at least one of an urging force and a displacement applied to move said tangs towards each other to permit withdrawal of said male connector from said female connector.

17. The seatbelt assembly according to claim 16, wherein said structural member comprises an inward shoulder extension on at least one lateral support, whereby said tangs are displaced a greater distance to permit disengagement of said male and female connectors.

18. A child seatbelt assembly having a buckle, comprising:

a strap portion having a retainer member on one end for retaining said strap portion to an object, said strap portion having a connector receiving member on another end;

a female connector of said buckle having lateral supports with inner ends; a male connector of said buckle having laterally resilient flexible tangs;

at least one of said male and female connectors being coupled to said connector receiving member;

said lateral supports arranged to urge said tangs towards each other when said male connector is inserted into said female connector;

at least one of said tangs having a length sufficient to extend beyond a respective lateral support when said male connector is sufficiently inserted into said female connector, whereby said at least one tang is no longer urged towards another tang and engages a respective inner end to resist withdrawal of said male connector from said female connector; and a structural member connected to said at least one tang sufficient to increase an urging force needed to disengage said at least one tang from said respective inner end to permit withdrawal of said male connector from said female connector.

19. A buckle compassing:

a female connector with lateral supports near a first end; a male connector with laterally resilient flexible tangs;

said lateral supports can receive said tangs when said male connector is inserted into said female connector;

said tangs being urged towards each other upon being received by said lateral supports;

said tangs having a length sufficient to extend beyond said lateral supports when said male connector is inserted a distance into said female connector, whereby said tangs are no longer urged towards each other and abut an inner end of said lateral supports to resist withdrawal of said male connector from said female connector;

a first structural member on at least one of said tangs sufficient to increase an urging force needed to move said tangs towards each other to permit withdrawal of said male connector from said female connector; and a second structural member on said female connector to thereby increase a resistance of said buckle to externally applied forces.

20. A child seatbelt assembly having a buckle, comprising:

a strap portion having a retainer member on one end for retaining said strap portion to an object, said strap portion having a connector receiving member on another end;

a female connector of said buckle having lateral supports with inner ends;

a male connector of said buckle having laterally resilient flexible tangs;

at least one of said male and female connectors being coupled to said connector receiving member;

said lateral supports arranged to urge said tangs towards each other when said male connector is inserted into said female connector;

at least one of said tangs having a length sufficient to extend beyond a respective lateral support when said male connector is sufficiently inserted into said female connector, whereby said at least one tang is no longer urged towards another tang and engages a respective inner end to resist withdrawal of said male connector from said female connector; and a structural member connected to said at least one tang sufficient to increase an urging force needed to disengage said at least one tang from said respective inner end to permit withdrawal of said male connector from said female connector; and said buckle being composed of material including an impact modified nylon.

21. A child seatbelt assembly having a buckle according to claim 20, wherein said impact modified nylon is greater than about 50% of said buckle material.

* * * * *